US007685665B2

(12) United States Patent
Warmuth

(10) Patent No.: US 7,685,665 B2
(45) Date of Patent: Mar. 30, 2010

(54) WASHING MACHINE HAVING SELF-CENTERING DRIVE ASSEMBLY

(75) Inventor: David Duane Warmuth, Louisville, KY (US)

(73) Assignee: General Electric Company, Schenectady, NY (US)

( * ) Notice: Subject to any disclaimer, the term of this patent is extended or adjusted under 35 U.S.C. 154(b) by 658 days.

(21) Appl. No.: 11/520,139

(22) Filed: Sep. 13, 2006

(65) Prior Publication Data

US 2008/0060388 A1 Mar. 13, 2008

(51) Int. Cl.
*D06F 37/40* (2006.01)
*D06F 23/00* (2006.01)

(52) U.S. Cl. ..... 8/158; 68/140

(58) Field of Classification Search ..... 8/158, 8/159; 68/140
See application file for complete search history.

(56) References Cited

U.S. PATENT DOCUMENTS

| | | | | | |
|---|---|---|---|---|---|
| 3,662,622 | A | | 5/1972 | Neumann | |
| 4,255,952 | A | | 3/1981 | Johnson | |
| 4,270,411 | A | | 6/1981 | Pengo et al. | |
| 4,283,928 | A | | 8/1981 | Stone | |
| 4,317,343 | A | * | 3/1982 | Gerry | 68/23.7 |
| 5,209,085 | A | * | 5/1993 | Brien | 68/23.7 |
| 5,267,456 | A | | 12/1993 | Nukaga et al. | |
| 5,269,160 | A | * | 12/1993 | Wood | 68/23.7 |
| 5,381,677 | A | * | 1/1995 | Park et al. | 68/23.7 |
| 5,551,261 | A | * | 9/1996 | Lyu et al. | 68/23.6 |
| 5,551,262 | A | * | 9/1996 | Seo | 68/23.7 |
| 5,680,778 | A | * | 10/1997 | Seo | 68/23.7 |
| 5,842,358 | A | | 12/1998 | Koo et al. | |
| 5,860,299 | A | | 1/1999 | Eum et al. | |
| 5,873,269 | A | | 2/1999 | Hong et al. | |
| 5,884,507 | A | * | 3/1999 | Lee et al. | 68/23.7 |
| 5,887,458 | A | * | 3/1999 | Bae | 68/23.7 |
| 5,934,107 | A | * | 8/1999 | Lee et al. | 68/3 R |
| 5,950,459 | A | * | 9/1999 | Takagi et al. | 68/23.6 |
| 6,077,184 | A | * | 6/2000 | Lee | 475/331 |
| 6,176,108 | B1 | * | 1/2001 | Bae et al. | 68/23.7 |
| 6,499,323 | B2 | | 12/2002 | Skrippek et al. | |
| 2004/0163429 | A1 | * | 8/2004 | Lim | 68/140 |
| 2004/0168485 | A1 | * | 9/2004 | Lim | 68/24 |
| 2005/0011233 | A1 | * | 1/2005 | Vaidhyanathan et al. | 68/23.7 |
| 2005/0081573 | A1 | * | 4/2005 | Han | 68/12.02 |
| 2005/0166643 | A1 | * | 8/2005 | Cho et al. | 68/12.02 |
| 2005/0223754 | A1 | * | 10/2005 | Choi | 68/3 R |
| 2006/0010612 | A1 | * | 1/2006 | Kim et al. | 8/158 |

* cited by examiner

*Primary Examiner*—Joseph L Perrin
(74) *Attorney, Agent, or Firm*—George L. Rideout, Esq.; Armstrong Teasdale LLP

(57) ABSTRACT

A drive assembly for a washing machine is provided. The drive assembly includes a motor. An input shaft is operatively coupled to the motor and an output shaft is operatively coupled between the input shaft and an agitator. A housing is positioned about at least a portion of the input shaft and at least a portion of the output shaft. A gear assembly is positioned within the housing and drivingly couples the input shaft to the output shaft. A first sleeve bearing is positioned about a bottom end of the input shaft opposing the top end. The first sleeve bearing is configured to radially support the input shaft and define a first radial clearance between the top end of the input shaft and the housing for facilitating radial movement of the top end of the input shaft with respect to the output shaft.

16 Claims, 3 Drawing Sheets

WASHING MACHINE HAVING SELF-CENTERING DRIVE ASSEMBLY

BACKGROUND OF THE INVENTION

This invention relates generally to washing machines and, more particularly, to a drive assembly for washing machines.

Washing machines typically include a cabinet that houses a stationary tub for containing wash and rinse water. A wash basket is rotatably mounted within the stationary tub, and an agitating element is positioned within the wash basket. A drive assembly located below the stationary tub is configured to rotate and control movement of the agitating element and/or the wash basket to clean the articles loaded into the wash basket. At an end of a wash cycle, a pump assembly is used to drain the soiled water to a drainage system.

Conventional drive assemblies generally include a motor, an input shaft coupled to the motor and an output shaft operatively coupled to the input shaft. In at least one conventional drive assembly, the input shaft is coupled at a first end to a pulley that is operatively coupled to the motor by a belt. The input shaft is operatively coupled at a second end opposing the first end to the output shaft. The output shaft is operatively coupled to the agitating element to produce an agitating movement and/or a continuous direct spin. The drive assembly also includes a gear assembly that drives the input shaft and output shaft to rotate about a vertical axis. However, in conventional drive assemblies relative movement of the input shaft with respect to the output shaft is restricted for facilitating a stable operation and performance of the drive assembly. The useful life of the gear assembly is greatly reduced due to undesirable contact between the components of the drive assembly and/or the misalignment of the input shaft and the output shaft. Further, such misalignment may produce undesirable noise during operation of the washing machine.

BRIEF DESCRIPTION OF THE INVENTION

In one aspect, a drive assembly for a washing machine is provided. The drive assembly includes a motor. An input shaft is operatively coupled to the motor and an output shaft is operatively coupled between the input shaft and an agitator. A housing is positioned about at least a portion of the input shaft and at least a portion of the output shaft. A gear assembly is positioned within the housing and drivingly couples the input shaft to the output shaft. A first bearing is positioned about a bottom end of the input shaft opposing the top end. The first bearing is configured to radially support the input shaft and define a first radial clearance between the top end of the input shaft and the housing for facilitating radial movement of the top end of the input shaft with respect to the output shaft.

In another aspect, a washing machine is provided. The washing machine includes a cabinet and a basket positioned within the cabinet. A motor is operatively coupled to the basket and configured to rotate the basket. A transmission assembly including an input shaft and an output shaft is provided. The input shaft is operatively coupled to the motor and the output shaft. A housing defines a chamber for containing the transmission assembly. A first sleeve bearing is positioned about a first end of the input shaft. The first sleeve bearing is configured to radially support the input shaft and define a radial clearance between the input shaft and the housing at a second end of the input shaft opposing the first end for facilitating radial movement of the second end of the input shaft.

In another aspect, a method is provided for assembling a washing machine. The method includes providing a cabinet, positioning a basket within the cabinet, and coupling a motor to the basket. The motor is configured to rotate the basket. A transmission assembly is operatively coupled to the motor. The transmission assembly includes an input shaft at least partially positioned within a housing. A first sleeve bearing is positioned about a first end of the input shaft. The first sleeve bearing is configured to radially support the input shaft and define a radial clearance between the input shaft and the housing at a second end of the input shaft opposing the first end for facilitating radial movement of the second end of the input shaft. An output shaft is operatively coupled to the input shaft. The method further includes operatively coupling a gear assembly to the motor. The gear assembly includes a sun gear positioned about the second end of the input shaft, a plurality of planet gears positioned about the sun gear, and a stationary ring gear positioned about the plurality of planet gears and fixedly coupled to the housing.

DETAILED DESCRIPTION OF THE INVENTION

Figure 1:
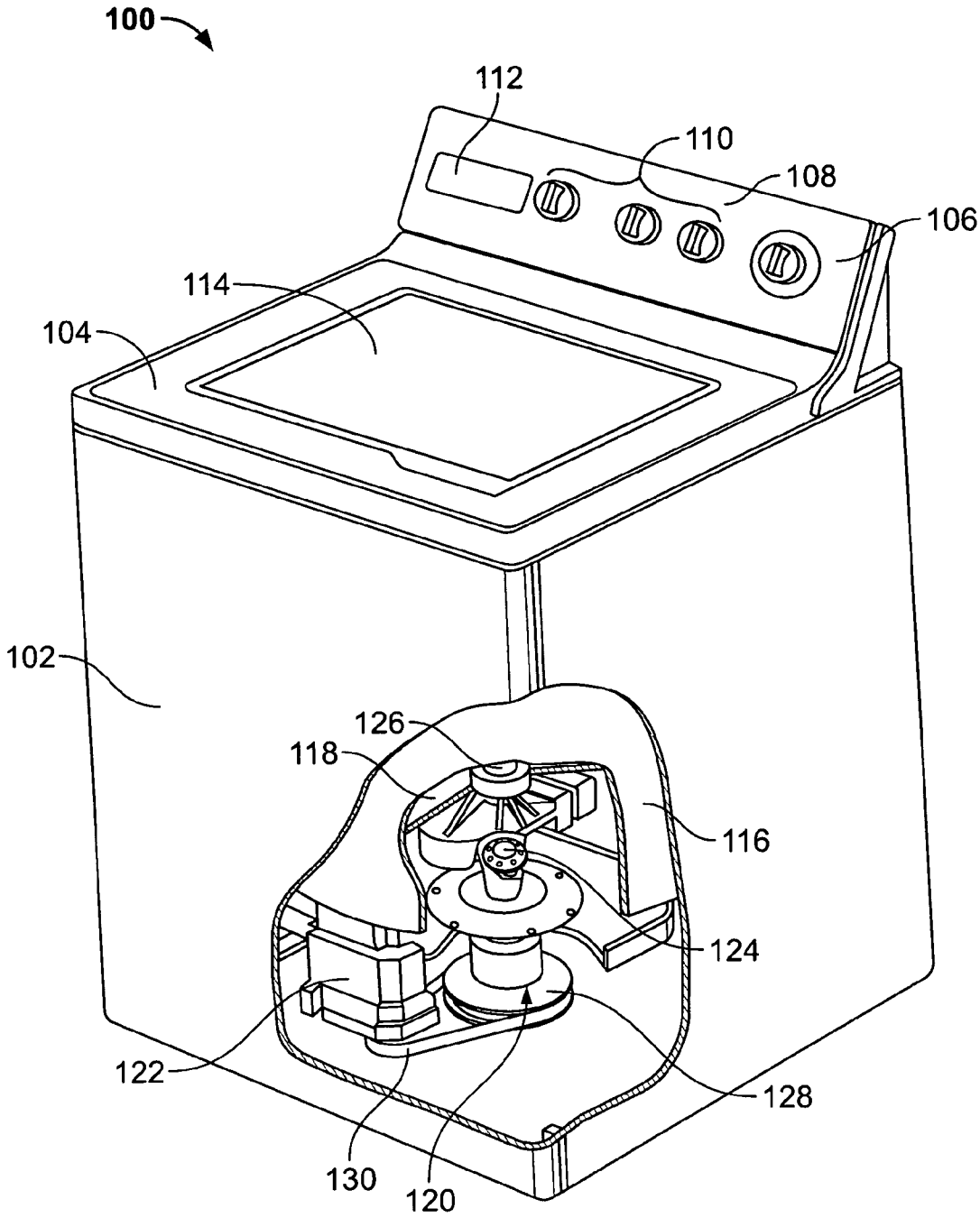
FIG. 1 is a perspective view of an exemplary washing machine with a portion of a housing removed.

FIG. 1 is a perspective view of an exemplary washing machine 100. As illustrated in FIG. 1, machine 100 is a vertical axis washing machine. However, it is apparent to those skilled in the art and guided by the teachings herein provided that the present invention may be incorporated into any suitable washing machine including, without limitation, horizontal axis machines.

Washing machine 100 includes a cabinet 102 and a cover 104. A backsplash 106 extends from cover 104, and a control panel 108 including a plurality of input selectors 110 is coupled to backsplash 106. Control panel 108 and input selectors 110 collectively form a user interface input for operator selection of machine cycles and/or washing features. In the exemplary embodiment, a display 112 indicates selected features, a countdown timer and/or other items of interest to machine users. A lid 114 is mounted to cover 104 and is rotatable about a hinge (not shown) between an open position (not shown) facilitating access to a wash tub 116 mounted within cabinet 102, and a closed position (shown in FIG. 1) forming a sealed enclosure over wash tub 116.

Wash tub 116 includes a basket 118 rotatably mounted within wash tub 116. In one embodiment, basket 118 includes a plurality of perforations defined therein for facilitating fluid communication between an interior cavity defined by the basket 118 and wash tub 116. A drive assembly 120 is mounted within cabinet 102 and positioned with respect to basket 118. Drive assembly 120 includes a motor 122, an input shaft 124 and an output shaft 126. Input shaft 124 is coupled to a pulley 128, which is driven by a belt 130 coupling pulley 128 to motor 122. Therefore, when motor 122 starts running, input shaft 124 rotates about a vertical axis (not shown) through pulley 128 and belt 130. Input shaft 124 is also engaged with a brake assembly 132. Drive assembly 120 is operatively coupled to control panel 108 and executes selected wash and rinse cycles of washing machine 100.

Figure 2:
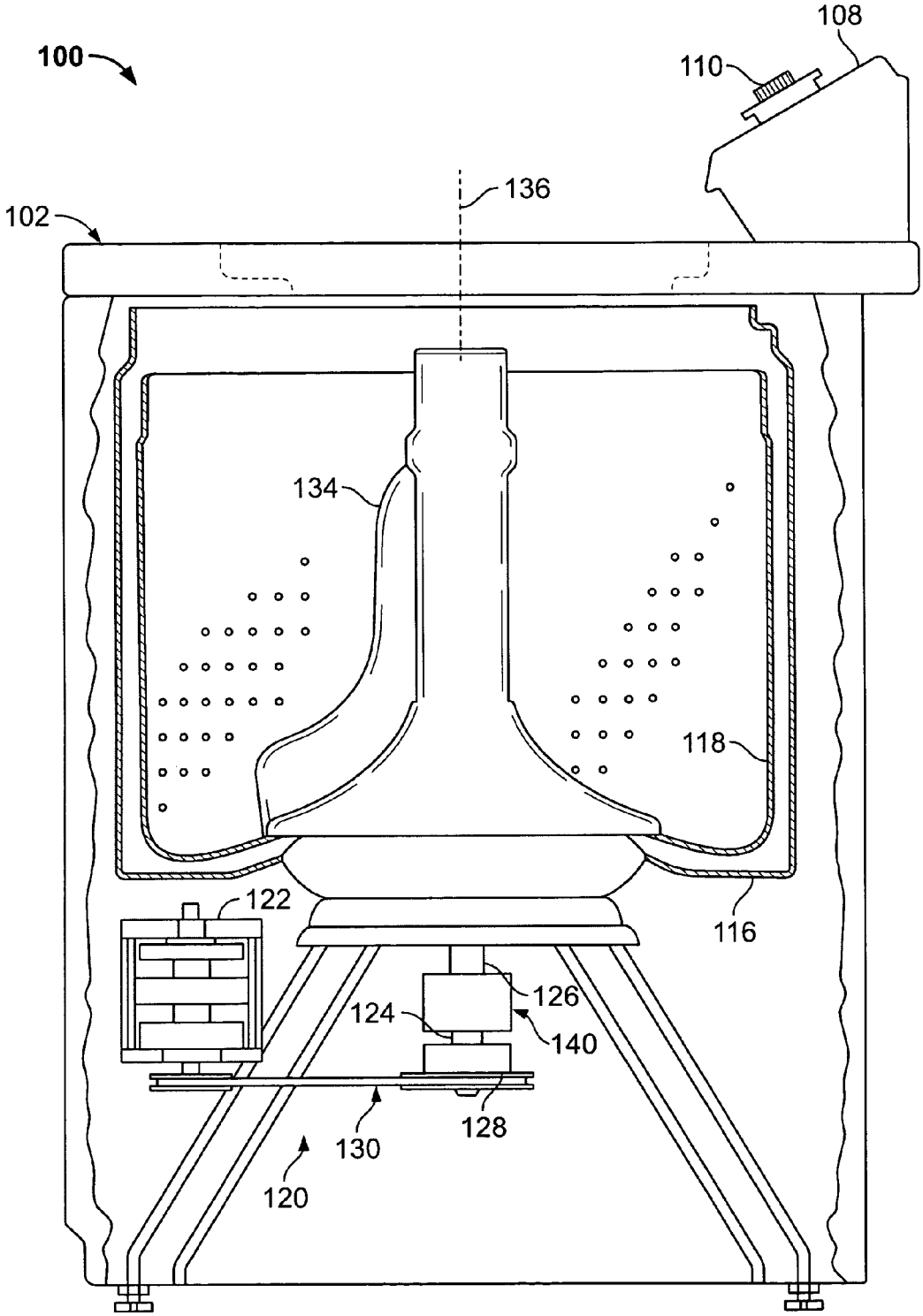
FIG. 2 is a partial sectional view of the washing machine shown in FIG. 1.

FIG. 2 is a side view of washing machine 100 shown in FIG. 1. An agitator 134 is positioned within basket 118 and is drivingly coupled to output shaft 126. Agitator 134 is driven by motor 122 and is rotated about a vertical axis 136 to impart an oscillatory motion to articles and liquid within basket 118. Basket 118 and agitator 134 are driven by drive assembly 120. In one embodiment, basket 118 rotates together with agitator 134 for centrifugal extraction of fluid from clothes in basket 118. As such, the fluid in the clothes can be extracted to tub 116, which then releases the extracted fluid from within washing machine 100.

Figure 3:
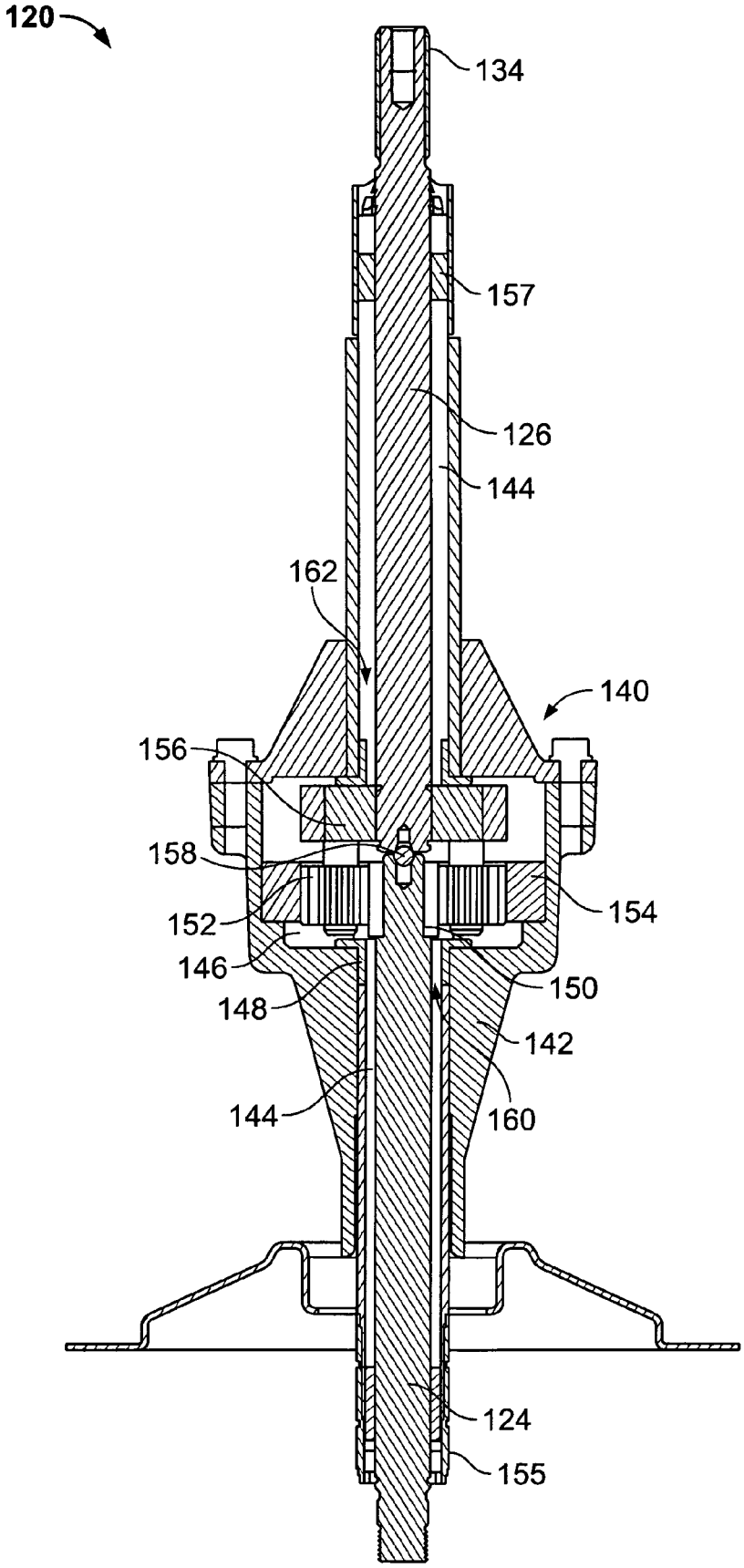
FIG. 3 is a partial sectional view of a drive assembly for the washing machine shown in FIG. 1.

FIG. 3 is a partially sectional view of drive assembly 120 of washing machine 100 shown in FIG. 1. Drive assembly 120 includes a gear assembly 140 drivingly coupling input shaft 124 to output shaft 126. Gear assembly 140 includes a housing 142 positioned about at least a portion of input shaft 124 and at least portion of output shaft 126. More particularly, housing 142 defines a passage 144 for housing a portion of input shaft 124 and a portion of output shaft 126. Housing 142 also defines a chamber 146 for containing a thrust bearing 148, a sun gear 150, a plurality of planet gears 152, a stationary ring gear 154, and a planet carrier 156 fixedly coupled to output shaft 126 and planet gears 152. Thrust bearing 148 is positioned within housing 142. Sun gear 150 is positioned around input shaft 124 at a top end of input shaft 124 and on thrust bearing 148, which rests on an inner portion of housing 142. Sun gear 150 is carried by thrust bearing 148. It is apparent to those skilled in the art and guided by the teachings herein provided that sun gear 150 may be supported by any suitable mechanical component or mechanism including, without limitation, a washer mounted to output shaft 126 or a step or shoulder formed on output shaft 126 configured to carry the axial load. The plurality of planet gears 152 is positioned about sun gear 150 and is rotatable with respect to sun gear 150. Ring gear 154 is positioned about the plurality of planet gears 152 and fixedly coupled to housing 142.

Drive assembly 120 also includes a bearing, such as a first sleeve bearing 155, positioned about input shaft 124 and configured to radially support input shaft 124. In a particular embodiment, first sleeve bearing 155 also axially supports input shaft 124. As shown in FIG. 3, first sleeve bearing 155 is positioned about a first or bottom portion of input shaft 124. First sleeve bearing 155 is configured to define a radial clearance indicated as 160 between input shaft 124 and an inner surface of housing 142 at a second or top end opposing the first end of input shaft 124 for facilitating radial movement of input shaft 124 with respect to output shaft 126. In one embodiment, first sleeve bearing 155 limits the radial movement of the bottom end of input shaft 124 and facilitates the radial movement of the top end of input shaft 124. As such, first sleeve bearing 155 and radial clearance 160 facilitate radial movement of the top end of input shaft 124 with respect to output shaft 126. In alternative embodiments, any suitable bearing system known to those skilled in the art and guided by the teachings herein provided may be used to support the bottom end of input shaft 124 while allowing the radial movement of the top end of input shaft 124 with respect to output shaft 126.

In one embodiment, drive assembly 120 also includes a bearing, such as a second sleeve bearing 157, positioned about output shaft 126 and configured to radially support output shaft 126. In a particular embodiment, second sleeve bearing 157 also axially supports output shaft 126. As shown in FIG. 3, second sleeve bearing 157 is positioned about a first or top end of output shaft 126. Second sleeve bearing 157 is configured to define a radial clearance indicated as 162 between output shaft 126 and the inner surface of housing 142 at a second or bottom end opposing the top end of output shaft 126. Radial clearance facilitates radial movement of the bottom end of output shaft 126 with respect to input shaft 124. In one embodiment, radial clearance 160 and/or radial clearance 162 are about 0.05 inch to 0.15 inch. In alternative embodiments, radial clearance 160 is substantially similar to radial clearance 162 or different from radial clearance 162, as required for desirable radial movement of the drive assembly components. In further alternative embodiments, radial clearance 160 and/or radial clearance 162 may have any suitable size and/or shape.

In one embodiment, second sleeve bearing 157 limits the radial movement of the top end of output shaft 126 and facilitates the radial movement of the bottom end of output shaft 126. As such, the bottom end of output shaft 126 may move radially with respect to the top end of input shaft 124. In alternative embodiments, any suitable bearing system known to those skilled in the art and guided by the teachings herein provided may be used to support the top end of output shaft 126 while allowing the radial movement of the bottom end of output shaft 126 with respect to input shaft 124.

In one embodiment, a ball bearing 158 is movably positioned between the top end of input shaft 124 and the bottom end of output shaft 126 for facilitating relative movement between input shaft 124 and output shaft 126. Ball bearing 158 limits axial movement of input shaft 124 and/or output shaft 126 for facilitating transferring an axial thrust load of output shaft 126 to input shaft 124 thereby carrying the axial thrust load of output shaft 126. Ball bearing 158 facilitates radial movement of the bottom end of output shaft 126 with respect to the top end of input shaft 124. Further, in a particular embodiment, ball bearing 158 is movable for facilitating operating input shaft 124 and output shaft 126 at a best center relative to sun gear 150.

In operation, motor 122 is energized to drive input shaft 124 to rotate. Sun gear 150 mounted at the top end of input shaft 124 then drives planet gears 152 to rotate within ring gear 154. Planet gears 152 in turn drive planet carrier 156 to rotate together with output shaft 126. In one embodiment, input shaft 124 is radially supported at least partially by first sleeve bearing 155 and/or gear assembly 140. As such, the top end of input shaft 124 may be radially positioned in an operating center with respect to gear assembly 140. First sleeve bearing 155, second sleeve bearing 157 and radial clearances 160, 162 enable the top end of input shaft 124 and the bottom end of output shaft 126 to move radially with respect to each other.

In one embodiment, a method is provided for assembling a washing machine. The method includes providing a cabinet, positioning a basket within the cabinet, and drivingly coupling a motor to the basket. The motor is configured to rotate the basket. A transmission assembly is operatively coupled to the motor. The transmission assembly includes an input shaft at least partially positioned within a housing. A first sleeve bearing is positioned about a first end of the input shaft. The first sleeve bearing is configured to radially and/or axially support the input shaft and define a radial clearance between the input shaft and the housing at a second end of the input shaft opposing the first end for facilitating radial movement of the second end of the input shaft.

An output shaft is operatively coupled to the input shaft. In one embodiment, a second sleeve bearing is positioned about a first end of the output shaft. The second sleeve bearing is configured to radially and/or axially support the output shaft and define a second radial clearance between a second end of the output shaft opposing the first end and the housing for facilitating radial movement of the second end of the output shaft with respect to the second end of the input shaft.

A gear assembly is operatively coupled to the motor. The gear assembly includes a sun gear positioned about the second end of the input shaft. A plurality of planet gears is positioned about the sun gear. A stationary ring gear is positioned about the plurality of planet gears and fixedly coupled to the housing. In one embodiment, a ball bearing is movably positioned between the second end of the input shaft and the second end of the output shaft. The ball bearing is configured for axially supporting the input shaft and facilitating aligning the input shaft and the output shaft.

While the invention has been described in terms of various specific embodiments, those skilled in the art will recognize that the invention can be practiced with modification within the spirit and scope of the claims.

What is claimed is:

1. A method for assembling a washing machine, said method comprising:

providing a cabinet;

positioning a basket within the cabinet;

coupling a motor to the basket, the motor configured to rotate the basket;

operatively coupling a transmission assembly to the motor, the transmission assembly comprising an input shaft at least partially positioned within a housing, a first sleeve bearing positioned about a first end portion of the input shaft, the first sleeve bearing configured to radially support the input shaft and define a radial clearance between the input shaft and the housing at a second end portion of the input shaft opposing the first end portion for facilitating radial movement of the second end portion of the input shaft, and an output shaft operatively coupled to the input shaft, the output shaft including a first end portion and a second end portion;

operatively coupling a gear assembly to the motor, the gear assembly comprising a sun gear positioned about the second end portion of the input shaft, a plurality of planet gears positioned about the sun gear, and a stationary ring gear positioned about the plurality of planet gears and fixedly coupled to the housing, and movably positioning a ball bearing between the second end portion of the input shaft and the second end portion of the output shaft, the ball bearing configured to facilitate carrying an axial thrust load of the output shaft, wherein the first sleeve bearing and the ball bearing facilitate radial movement between the input shaft and the output shaft.

2. A method in accordance with claim 1 wherein operatively coupling a gear assembly to the motor further comprises providing a second sleeve bearing positioned about a first end portion of the output shaft, the second sleeve bearing configured to radially support the output shaft and define a second radial clearance between a second end portion of the output shaft opposing the first end portion and the housing for facilitating radial movement of the second end portion of the output shaft with respect to the second end portion of the input shaft.

3. A drive assembly for a washing machine, said drive assembly comprising:

a motor;

an input shaft operatively coupled to said motor;

an output shaft operatively coupled between said input shaft and an agitator;

a housing positioned about at least a portion of said input shaft and at least a portion of said output shaft;

a gear assembly positioned within the housing and drivingly coupling said input shaft to said output shaft;

a first bearing positioned about a bottom end portion of said input shaft opposing a top end portion, said first bearing configured to radially support said input shaft and define a first radial clearance between said top end portion of said input shaft and said housing for facilitating radial movement of said top end portion of said input shaft with respect to said output shaft; and a ball bearing movably positioned between said top end portion of said input shaft and said bottom end portion of said output shaft to facilitate carrying an axial thrust load of said output shaft, wherein said first bearing and said ball bearing facilitate radial movement between said input shaft and said output shaft.

4. A drive assembly in accordance with claim 3 wherein said gear assembly further comprises:

a sun gear positioned about said top end portion of said input shaft;

a plurality of planet gears positioned about said sun gear; and a ring gear positioned about said plurality of planet gears and fixedly coupled to said housing.

5. A drive assembly in accordance with claim 3 further comprising a second bearing positioned about a top end portion of said output shaft, said second bearing configured to radially support said output shaft and define a second radial clearance between a bottom end portion of said output shaft opposing said top end portion and said housing for facilitating radial movement of said bottom end portion of said output shaft with respect to said top end portion of said input shaft.

6. A drive assembly in accordance with claim 3 wherein said gear assembly is positioned about said top end portion of said input shaft for facilitating limiting radial movement of said top end portion of said input shaft.

7. A drive assembly in accordance with claim 3 wherein said gear assembly further comprises a planet carrier fixedly coupled to a bottom end portion of said output shaft and a plurality of planet gears operatively coupled to said planet carrier.

8. A drive assembly in accordance with claim 3 further comprising a sun gear positioned about said top end portion of said input shaft, a plurality of planet gears surrounding said sun gear, and a stationary ring gear surrounding said plurality of planet gears and fixedly coupled to said housing.

9. A drive assembly in accordance with claim 8 wherein said sun gear is at least partially supported by one of a thrust bearing positioned about said input shaft, a washer positioned about said input shaft and a step formed in said input shaft.

10. A drive assembly in accordance with claim 8 further comprising a planet carrier operatively coupled to said plurality of planet gears, said planet carrier fixedly coupled to said output shaft.

11. A washing machine comprising:

a cabinet;

a basket positioned within said cabinet;

a motor operatively coupled to said basket and configured to rotate said basket;

a transmission assembly comprising an input shaft and an output shaft including a first end portion and a second end portion, said input shaft operatively coupled to said motor and said output shaft;

a housing defining a chamber for containing said transmission assembly;

a first sleeve bearing positioned about a first end portion of said input shaft, said first sleeve bearing configured to radially support said input shaft, said first sleeve bearing configured to define a radial clearance between said input shaft and said housing at a second end portion of said input shaft opposing said first end portion for facilitating radial movement of said second end portion of said input shaft; and a ball bearing movably positioned between said second end portion of said input shaft and said second end portion of said output shaft, said ball bearing configured to facilitate carrying an axial thrust load of said output shaft, wherein said first sleeve bearing and said ball bearing facilitate radial movement between said input shaft and said output shaft.

12. A washing machine in accordance with claim 11 further comprising a second sleeve bearing positioned about a first end portion of said output shaft, said second sleeve bearing configured to define a second radial clearance between an opposing second end portion of said output shaft and said housing for facilitating radial movement of said second end portion of said output shaft.

13. A washing machine in accordance with claim 12 wherein said first sleeve bearing positioned about a bottom portion of said input shaft and said second sleeve bearing is positioned about a top portion of said output shaft.

14. A washing machine in accordance with claim 11 further comprising a thrust bearing positioned about said input shaft, and a sun gear positioned on said thrust bearing and about said second end portion of said input shaft.

15. A washing machine in accordance with claim 11 further comprising a sun gear positioned about said second end portion of said input shaft, a plurality of planet gears surrounding said sun gear, and a stationary ring gear surrounding said plurality of planet gears and fixedly coupled to said housing.

16. A washing machine in accordance with claim 15 further comprising a planet carrier operatively coupled to said plurality of planet gears, said planet carrier fixedly coupled to said output shaft.

* * * * *